US010702045B2

(12) United States Patent
Piche-Rouillard

(10) Patent No.: US 10,702,045 B2
(45) Date of Patent: Jul. 7, 2020

(54) ADJUSTABLE HARNESS FOR BACKPACKS AND METHOD OF USING THE SAME

(71) Applicant: LES SACS BAKU INC., Ile-Bizard, QC (CA)

(72) Inventor: Sidney Piche-Rouillard, Ile-Bizard (CA)

(73) Assignee: Sidney Piché-Rouillard, Blainville (CA)

( * ) Notice: Subject to any disclaimer, the term of this patent is extended or adjusted under 35 U.S.C. 154(b) by 0 days.

(21) Appl. No.: 15/915,822

(22) Filed: Mar. 8, 2018

(65) Prior Publication Data

US 2018/0255909 A1 Sep. 13, 2018

(30) Foreign Application Priority Data

Mar. 10, 2017 (CA) ..... 2960478

(51) Int. Cl.
*A45F 3/04* (2006.01)
*A45F 3/00* (2006.01)
*A45F 3/14* (2006.01)

(52) U.S. Cl.
CPC ..... *A45F 3/00* (2013.01); *A45F 3/04* (2013.01); *A45F 3/14* (2013.01); *A45F 2003/001* (2013.01); *A45F 2003/146* (2013.01)

(58) Field of Classification Search
CPC ..... A45F 3/00; A45F 3/04; A45F 3/14; A45F 2003/001; A45F 2003/146; A45F 2003/045; A45F 3/10; A45F 3/047; A45F 3/08
See application file for complete search history.

(56) References Cited

U.S. PATENT DOCUMENTS 3,733,017 A 5/1973 Pletz
4,333,591 A 6/1982 Case
5,704,530 A 1/1998 Scherer
5,724,707 A * 3/1998 Kirk ..... A41D 13/0012 2/102
5,971,244 A * 10/1999 Jaeger ..... A45F 3/08 224/632

(Continued)

FOREIGN PATENT DOCUMENTS

EP 2203087 B1 5/2016
WO 2009/005782 A2 1/2009

(Continued)

*Primary Examiner* — Corey N Skurdal
(74) *Attorney, Agent, or Firm* — Damien Calvet; Gowling (WLG) Canada LLP

(57) ABSTRACT

A harness for backpack having an adjustable longitudinal length is disclosed. The harness has a top section and a bottom section slidably engaging one to each other; at least one holding system extending from the top section to the bottom section of the harness for holding the harness on a user's back; and an adjusting element connecting the top and bottom sections and configured for maintaining the longitudinal length of the harness once the longitudinal length is adjusted to a given length adapted to the user's back. A kit for assembling a packsack and methods for adjusting the harness are also disclosed. The harness according to the present invention is easily adjustable and particularly adapted for kids and school packsacks. When the kid is growing in size, the kid can easily adjust the longitudinal length without having to disassemble the harness from the pouch.

18 Claims, 12 Drawing Sheets

(56) References Cited

U.S. PATENT DOCUMENTS

| | | | | |
|---|---|---|---|---|
| 6,626,342 | B1 * | 9/2003 | Gleason | A45F 3/08 224/633 |
| 7,080,430 | B2 | 7/2006 | Wemmer | |
| 7,770,769 | B2 * | 8/2010 | Hurn | A45F 3/047 224/579 |
| 8,844,781 | B2 | 9/2014 | Rose et al. | |
| 8,997,262 | B2 * | 4/2015 | Klein | A45F 3/06 2/108 |
| 9,462,875 | B2 * | 10/2016 | Paduano | A45F 3/047 |
| 9,591,910 | B2 * | 3/2017 | Kemp | A45F 3/047 |
| 2006/0000856 | A1 | 1/2006 | West | |
| 2006/0113344 | A1 | 6/2006 | Cragg | |
| 2013/0037347 | A1 | 2/2013 | Wood | |
| 2013/0327803 | A1 | 12/2013 | Chiang | |
| 2014/0361058 | A1 * | 12/2014 | Gill | A45F 3/04 224/259 |
| 2015/0173494 | A1 * | 6/2015 | Kax | A45F 3/04 224/627 |
| 2016/0040958 | A1 | 2/2016 | Alcantra et al. | |

FOREIGN PATENT DOCUMENTS

| | | | |
|---|---|---|---|
| WO | 2009/052769 | A2 | 4/2009 |
| WO | 2009/096933 | A1 | 8/2009 |
| WO | 2011/100074 | A1 | 8/2011 |

* cited by examiner

ADJUSTABLE HARNESS FOR BACKPACKS AND METHOD OF USING THE SAME

CROSS-REFERENCE TO RELATED APPLICATION

The present application claims the benefit of priority of Canadian patent application no. 2,960,478 filed on Mar. 10, 2017 at the Canadian Intellectual Property Office, the content of which is incorporated herein by reference.

FIELD OF THE INVENTION

The present invention generally relates to a harness for pack sacs, backpacks or other load carrier devices, and more particularly to a harness for kids adjustable in size when the kid is growing.

BACKGROUND OF THE INVENTION

Backpacks and other load carrier devices and systems are often designed to fit over the shoulders of a user who is carrying the load. Thus, the shoulder straps generally place the weight of the load on the user's shoulders.

Backpacks are made in a size adapted to the size of the user. For instance, backpack for kids, such as those the kids are using for school, are smaller in size than the backpack for adults. Since kids are growing fast, the backpack becomes too small and does not fit the kid's body, leading to discomfort when the kid uses the backpack. The parents has no choice but to buy a new packsack.

US patent application no. US 2014/0361058 (Gill et al.) describes an adjustable device for supporting a load including a belt for fastening about the user' waist. This system is particularly adapted for adults, such as in military uses, and includes complicated mechanical adjustment systems.

There is thus a need for a new adjustable device or harness for backpacks which is simpler in its configuration such as a kid can use it and easily adapt the size of the device to fit with the kid's size.

SUMMARY OF THE INVENTION

The shortcomings of the prior art are generally mitigated by an adjustable harness for backpack and a method of using the same.

The invention is thus first directed to harness for a backpack having an adjustable longitudinal length, the harness comprising:

a top section and a bottom section slidably engaging one to each other;

at least one holding system extending from the top section to the bottom section of the harness for holding the harness on a user's back; and an adjusting element connecting the top and bottom sections and configured for maintaining the longitudinal length of the harness once the longitudinal length is adjusted to a given length adapted to the user's back.

According to a preferred embodiment, the top section defines a pocket having an aperture, the bottom section being configured to slide within the pocket through the aperture for adjusting the longitudinal length of the harness.

The harness may preferably further comprise a securing strap permanently connecting the bottom section to the top section inside the pocket, the securing strap being entirely hidden inside the pocket when the bottom section is inserted in the pocket of the top section.

According to a preferred embodiment, the adjusting element comprises an adjusting strap having one end secured to the bottom section and a buckle secured to the top section and configured for receiving the adjusting strap. More preferably, the bottom section has an outside surface for facing the user's back, the outside surface defining an extensible net forming a compartment for hiding an excess of the securing strap once the securing strap is connected to the buckle, such as, but not limited to, a ladderlock buckle.

According to a preferred embodiment, the top and bottom sections further comprise at least one cushioning pad extending from a surface intended to face the user's back.

According to a preferred embodiment, the top and bottom sections comprise an air knit fabric facing the user's back.

According to a preferred embodiment, the bottom section comprises a fixing pad attached thereto for facing a pouch of the backpack; the fixing pad comprising a plurality of holes arranged in rows and columns, the pouch comprising at least one fixing strap having one end secured to the pouch and another end configured to be intermingled in the holes of the fixing pad for fixing the pouch to the harness. Preferably, the other end fixing strap is configured to be snapped to the pouch once the fixing strap is intermingled in the fixing pad of the harness.

According to a preferred embodiment, the harness further comprises a rigid flat component embedded inside the bottom section along the longitudinal axis thereof for rigidifying the bottom section.

According to a preferred embodiment, the at least one holding system comprises a pair of straps extending from the top section to the bottom section and configured to hold the harness on the user's back and to be adjustable in length.

According to a preferred embodiment, the harness is for use for assembling a backpack having a pouch, the harness being adjustable to fit the size of a user of the backpack. Preferably, the user is a kid, the harness being then adjustable when the kid is ageing and growing in size.

A kit for assembling a packsack is also disclosed. The kit comprising:

a harness as defined herein; and at least one pouch configured to be attached to the harness.

A method for adjusting a harness of a backpack is also disclosed. The harness is as defined herein and is optionally removably attached to a pouch. The method comprises the steps of:

a) optionally disassembling the harness from the pouch of the backpack;

b) disengaging the adjusting element to the top and bottom sections of the harness to slide one to each other until to reach a desired longitudinal length of the harness;

c) engaging the adjusting element to maintain the desired longitudinal length of the harness; and d) optionally reassembling the harness to the pouch of the backpack.

The harness according to the present invention is easily adjustable and particularly adapted for kids and school packsacks. The harness can be first precisely adjusted to the size of the user. Also, when the kid is growing up, the kid can easily adjust the longitudinal length and there is no need to buy a new packsack. The harness can be adjusted without having to disassemble the harness from the pouch. The harness is disassembled from the pouch in case, for instance, the pouch is replaced by another pouch of different size.

Although the present invention is particularly adapted for being used by kids, the adjustable harness can be also used for adult packsacks for adjusting the longitudinal length of harness to the length of the back or torso of the person using the harness. Also, a same harness can be used by different persons having different body size and precisely adjusted thereto for comfort sake.

Other and further aspects and advantages of the present invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The above and other aspects, features and advantages of the invention will become more readily apparent from the following description, reference being made to the accompanying drawings in which.

DETAILED DESCRIPTION OF THE PREFERRED EMBODIMENT

Figure 1:
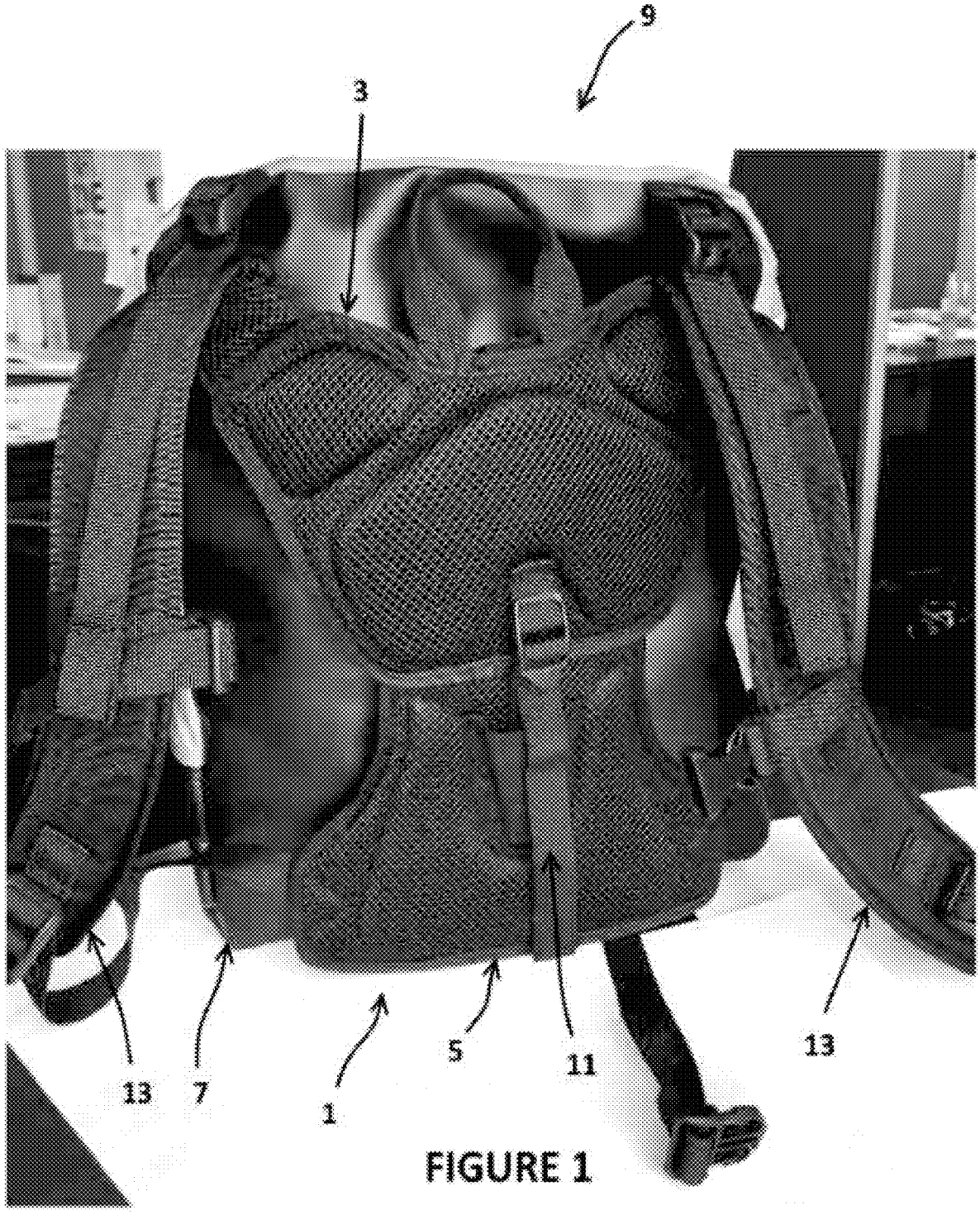
FIG. 1 illustrates a harness assembled to a pouch in accordance with a preferred embodiment of the invention.
Figure 2:
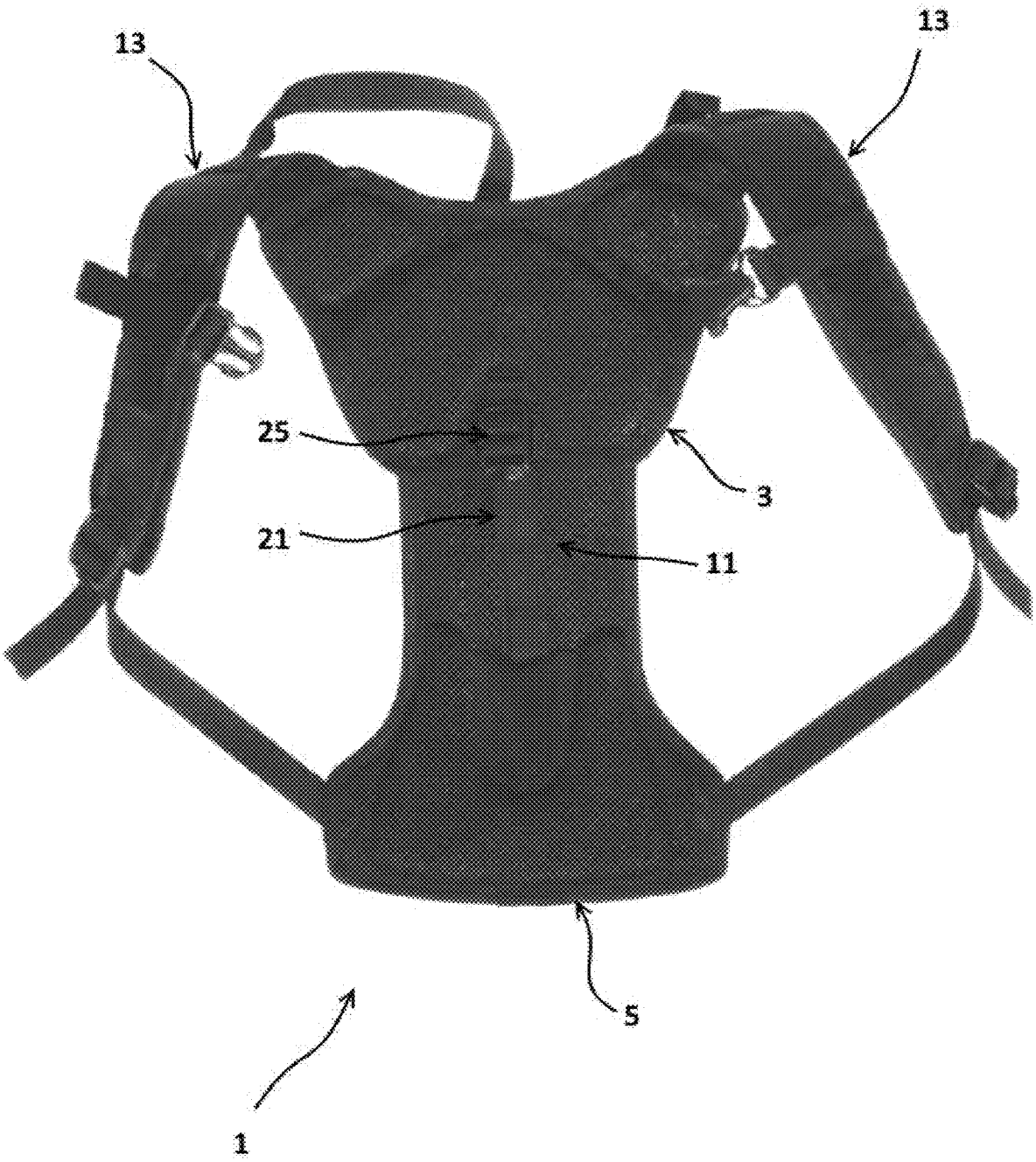
FIG. 2 illustrates the inside surface of a harness in accordance with a preferred embodiment of the invention.
Figure 3:
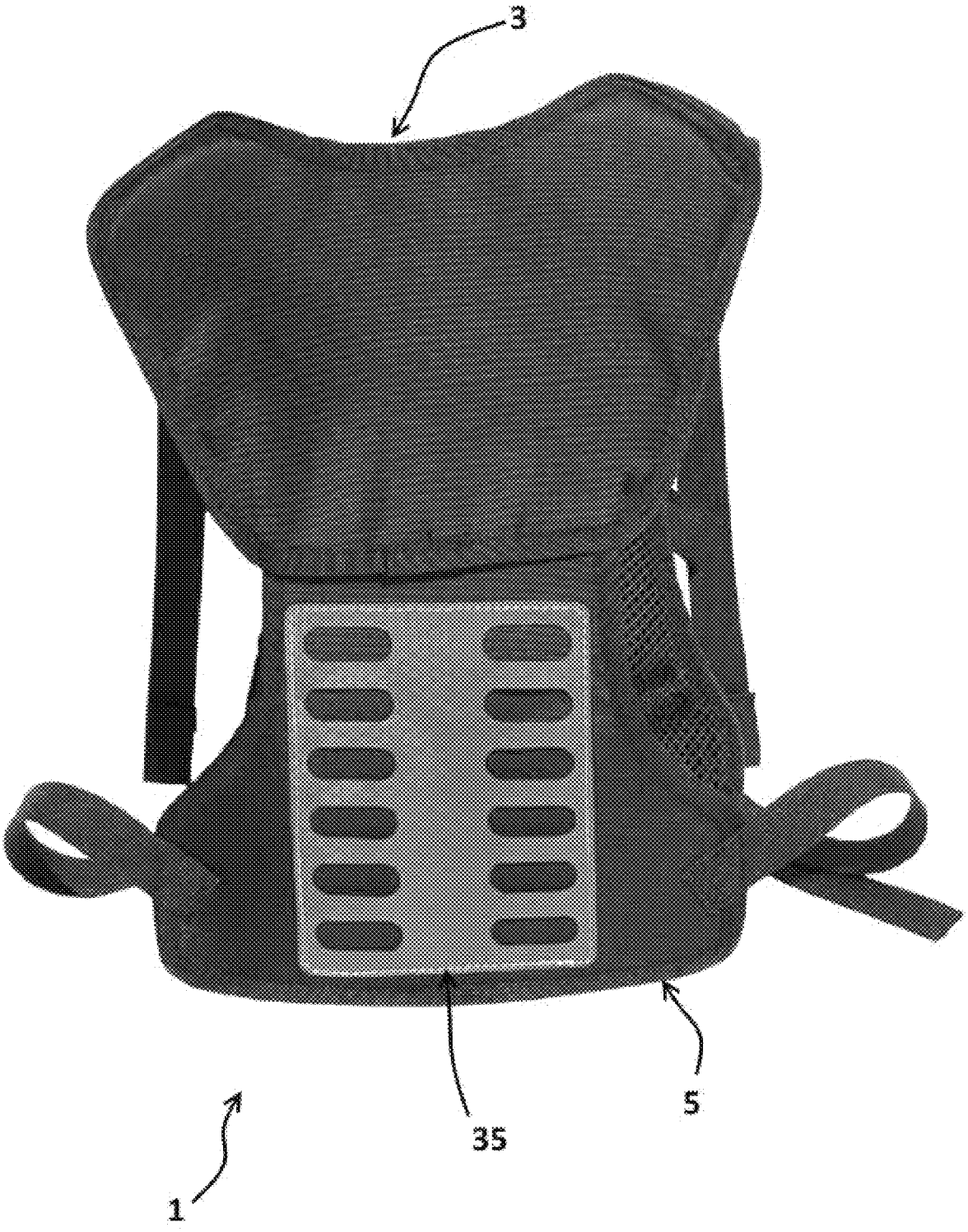
FIG. 3 illustrates the outside surface of a harness in accordance with a preferred embodiment of the invention.

Novel adjustable harness, kit and methods will be described hereinafter. Although the invention is described in terms of specific illustrative embodiments, it is to be understood that the embodiments described herein are by way of example only and that the scope of the invention is not intended to be limited thereby.

The Harness:

As aforesaid, the invention is thus first directed to a harness for backpack, the harness having an adjustable longitudinal length.

According to the preferred embodiment illustrated on FIGS. 1 to 5, the harness (1) comprises a top section (3) and a bottom section (5) for slidably engaging with the top section (3). The bottom section (5) is configured to be removably attached to a pouch (7) of a backpack (9), such as using a fixing pad as described herein after.

An adjusting element (11) connects the top and bottom sections (3, 5) and is configured for adjusting and maintaining the longitudinal length of the harness (1).

A pair of straps (13) extends from the top section (3) to the bottom section (5) and is configured to hold the harness (1) on the user's back. Any kinds of straps for backpack known in the art kind can be used.

Figure 4:
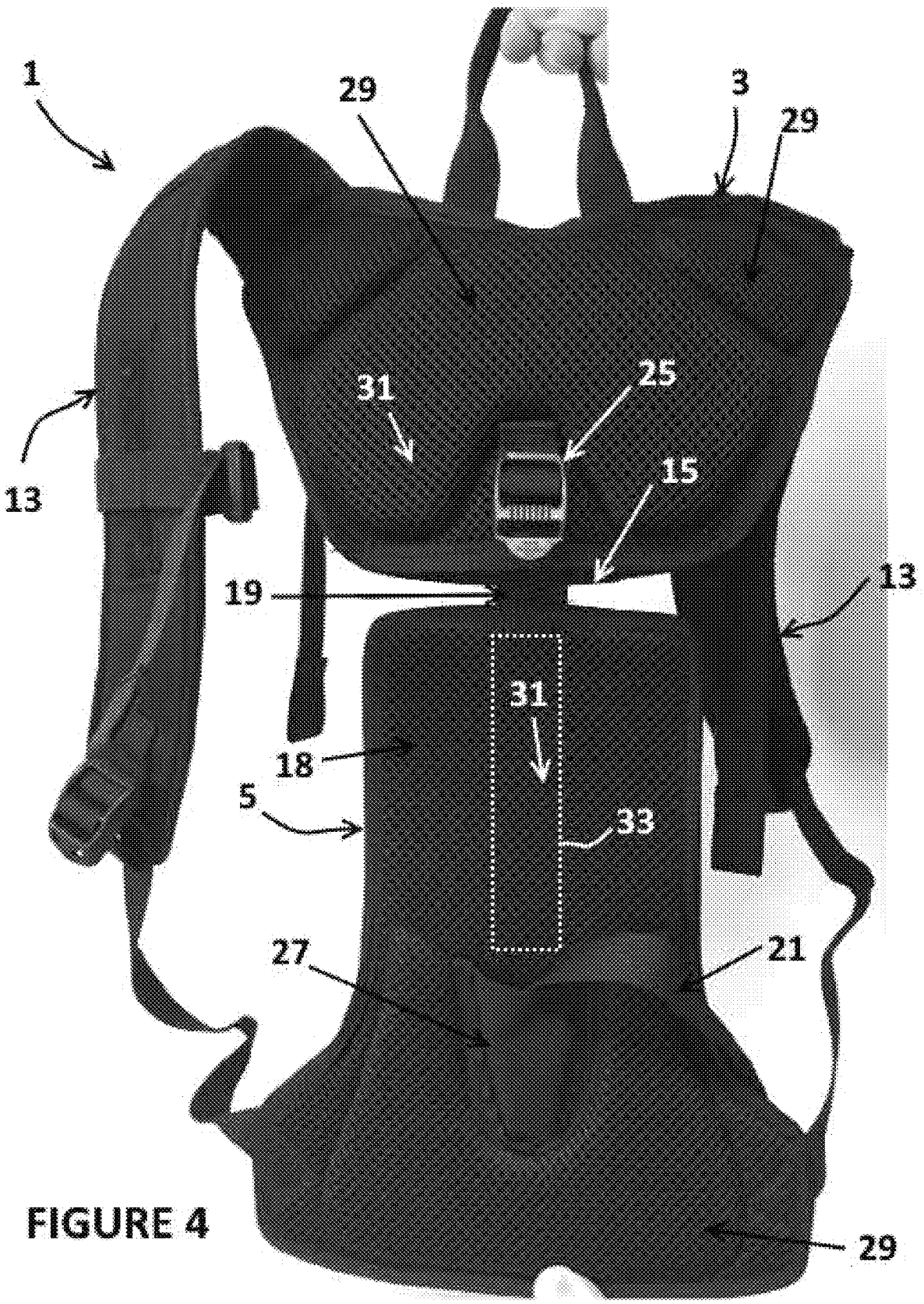
FIG. 4 illustrates a harness in accordance with a preferred embodiment of the invention, wherein the bottom section is disengaged from the top section.
Figure 5:
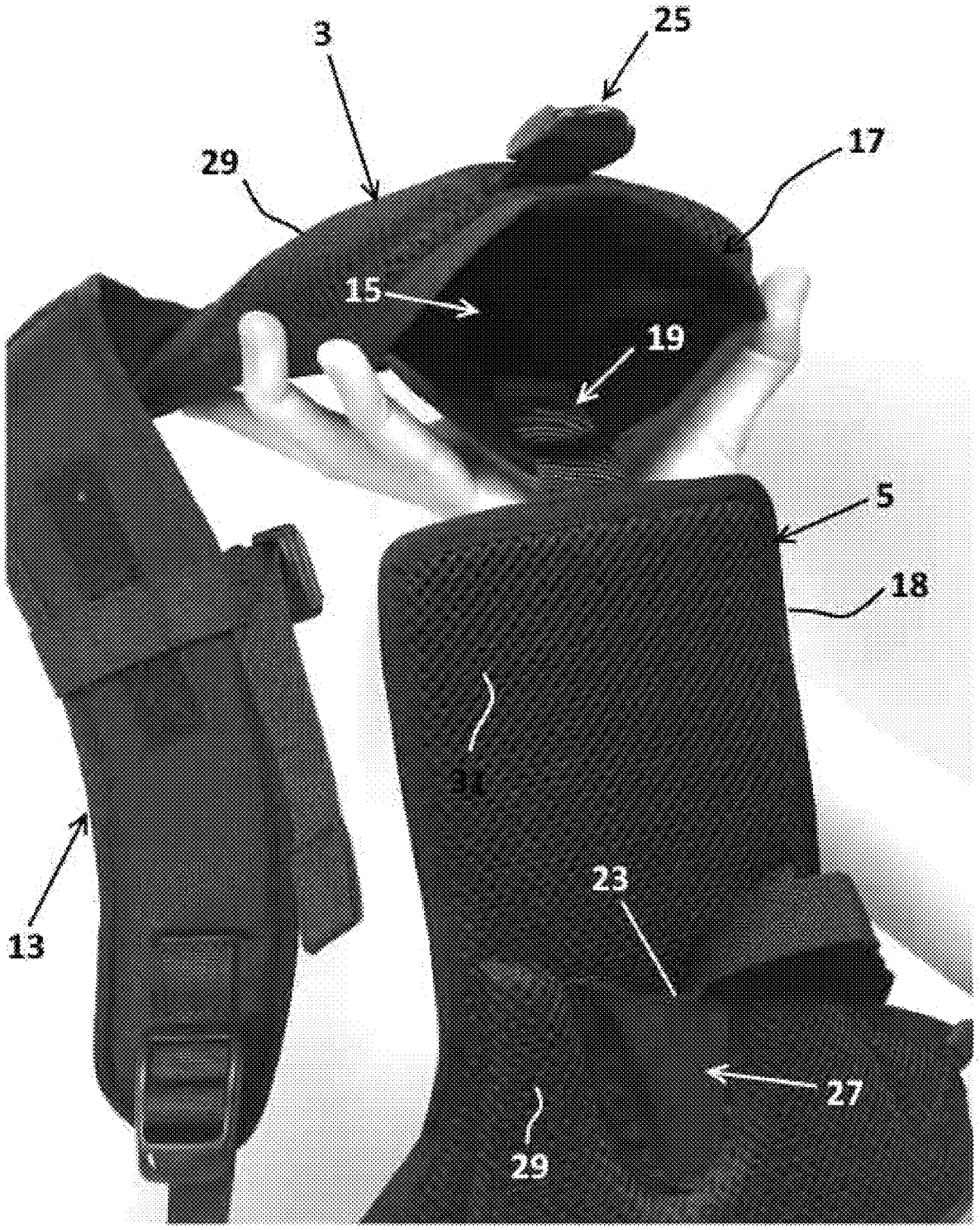
FIG. 5 illustrates a harness in accordance with a preferred embodiment of the invention, showing the pocket of the top section and the securing strap.

According to the preferred embodiment illustrated on FIGS. 4 and 5, the top section (3) of the harness (1) defines a pocket (15) having an aperture (17). In the present example, the pocket is formed by two layers of fabric having their edges connected together (e.g. sewed, extruded, or glued), except on one side forming the aperture (17). The bottom section (5) of the harness, generally made of one layer of the same fabric than the top section, is configured to slide within the pocket (15) through the aperture (17) for adjusting the longitudinal length of the harness. In the example, the bottom section has a longitudinal part (18) having a width matching the aperture for properly sliding into it.

Figure 6:
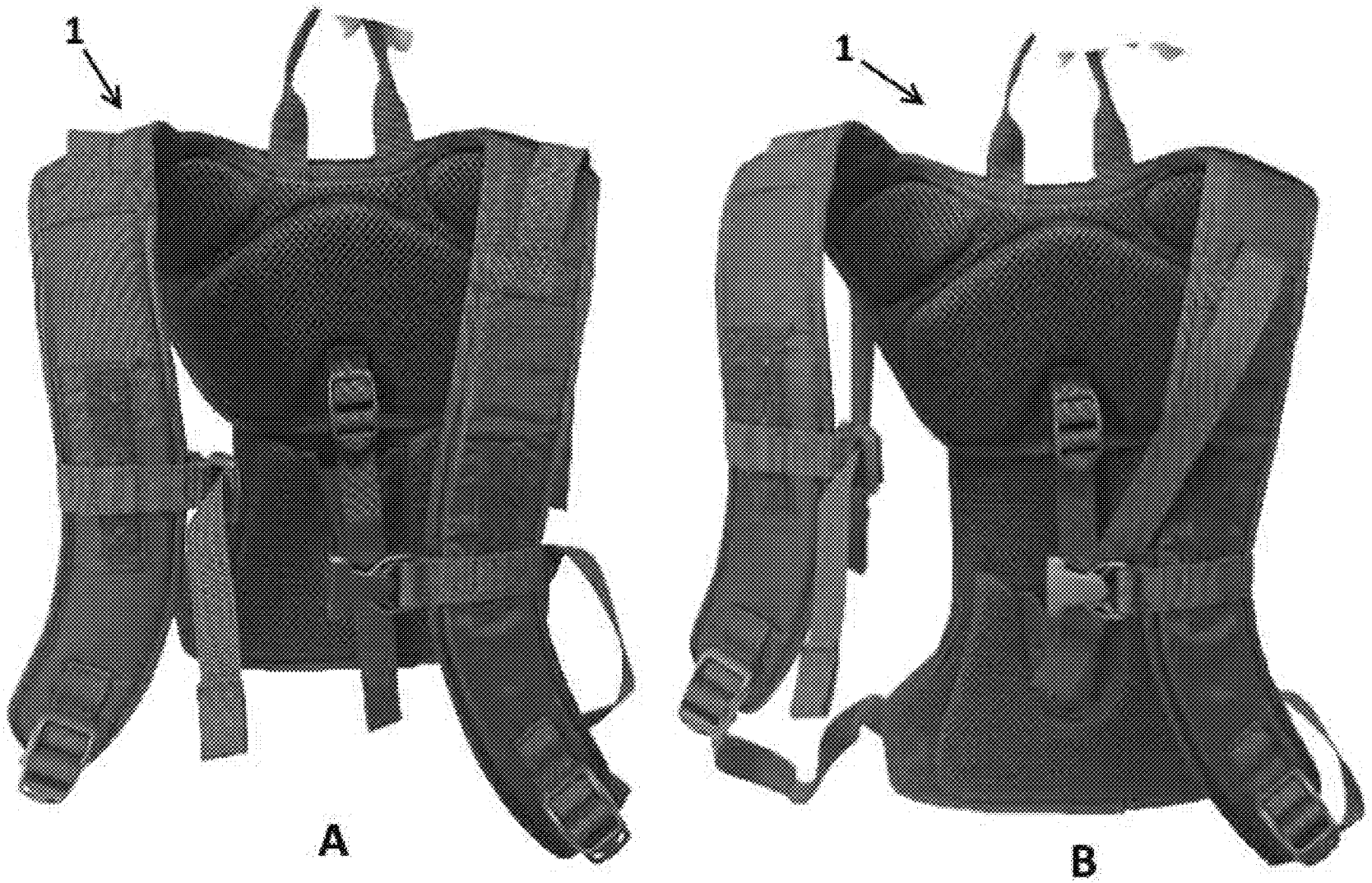
FIG. 6 illustrates a harness in accordance with a preferred embodiment of the invention in a compact configuration (A) and an extended configuration (B)
Figure 7:
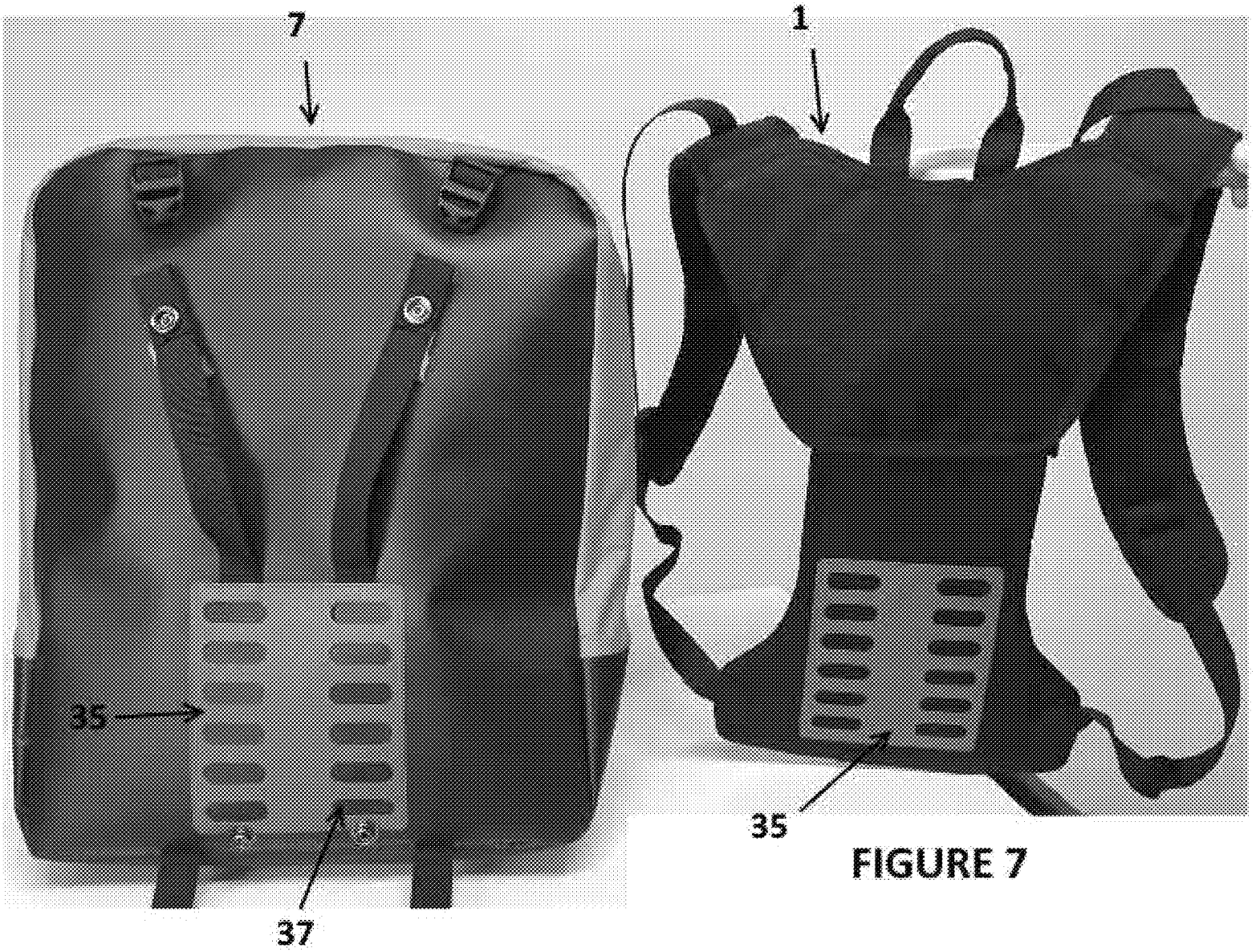
FIG. 7 illustrates a kit in accordance with a preferred embodiment of the invention comprising a pouch and a harness.

Accordingly, the longitudinal length of the harness can be adjusted between two extreme lengths illustrated on FIG. 6, with in (A) the bottom section (5) almost entirely inserted in the pocket of the top section (3) providing a short harness, or in (B) the bottom section (5) almost entirely outside the pocket of the top section (3) providing a long harness.

Visible on FIGS. 4 and 5, the harness (1) may further comprise a securing strap (19) permanently connecting the bottom section (5) to the top section (3) inside the pocket (15). In general, the securing strap (19) can be entirely hidden inside the pocket (15) when the bottom section (5) is partially or fully inserted into the pocket (15) of the top section (3), as illustrated for instance on FIG. 6.

According to the preferred embodiment illustrated on the Figures, the adjusting element (11) comprises an adjusting strap (21) having one end (23) secured to the bottom section (5) and a buckle (25) secured to the top section (3) and configured for receiving and maintaining the adjusting strap (21). The buckle (25) can be of any kind known in the art, such as, but not limited to, a ladderlock buckle as illustrated on the Figures.

The bottom section (5) has an outside surface for facing the user's back, the outside surface comprising a compartment, made for instance by an extensible net (27), for hiding an excess of the securing strap once the securing strap is connected to the buckle (25). Also the compartment provide better comfort when the harness is worn since the excess of strap is not directly in contact with the user's back.

According to another preferred embodiment, the top and bottom sections of the harness may comprise a plurality of cushioning pads (29) facing the user's back. The pads add comfort when the backpack is worn by the user. Any kind of pads known in the art of backpack manufacture can be used.

According to another preferred embodiment, the top and bottom sections of the harness also comprise a air knit fabric (31) facing the user's back. The air knit fabric can embed the cushioning pads (29). The air knot fabric is a breathable fabric adding comfort to the user by allowing air to circulate between the user's back and the harness. Any kind of air knit fabric known in the art of backpack manufacture can be used.

According to another preferred embodiment, the harness (1) may further comprise a rigid flat component (33) embedded inside the bottom section (5) along the longitudinal axis thereof for rigidifying the bottom section id needs be. The rigid flat component is made of metal or plastic such as HDPE.

The materials used for the making of the harness are known in the art and comprises fabrics made of natural or synthetic fibbers such as Nylon® and/or PVC. The bottom of the pouches can be made of PVC to assure higher resistance and waterproofing of the bag. The cushioning pads can be made of foam. Air knit fabric can cover all the sections on one side and sown tight on the pads to maintain the foam in place.

Fixing Pad:

According to another preferred embodiment particularly visible on FIGS. 7 and 9-11, the bottom section comprises a fixing pad (35) attached thereto and facing the pouch (7) of the backpack (9).

The concept of the fixing pad is inspired from the fixing system named MOLLE. MOLLE is an acronym for Modular Lightweight Load-carrying Equipment used to define the current generation of load-bearing equipment and backpacks utilized by a number of NATO armed forces, especially the British Army and the United States Army. The system's modularity is derived from the use of PALS (Pouch Attachment Ladder System) webbing as rows of heavy-duty nylon stitched onto the vest to allow for the attachment of various MOLLE-compatible pouches and accessories.

The fixing pad (35) in accordance with the preferred embodiment illustrated on the Figures is much simpler than the MOLLE or PALS system known in the art, in that it is made of one or more sheets of material (fabric, plastic, etc) comprising a plurality of holes (37), preferably ovoid holes arranged in rows (39) and columns (41). The pouch (7) comprises at least one fixing strap (43) having one end (45) secured to the pouch (7 or 51) and adjacent to the top end of a column (41) of the fixing pad (35), and another other end (47) configured to be intermingled in the holes (37) of the fixing pad for fixing the pouch to the harness. More preferably, the other end fixing strap is configured to be fixed to the pouch once the fixing strap has been intermingled in the holes along the columns of the fixing pad of the harness. Preferably, the strap is ended with a snap (49) snapped at the other end of the column of the fixing pad (e.g. see FIG. 10).

The fixing pad in the example illustrated herein is generally made of two layers of Nylon® ripstop (2.2 oz PU coated) glued together with a double-face sticker. The fixing pad can be sewed to its support using Oxford Nylon®. The holes can be laser cut.

Figure 11:
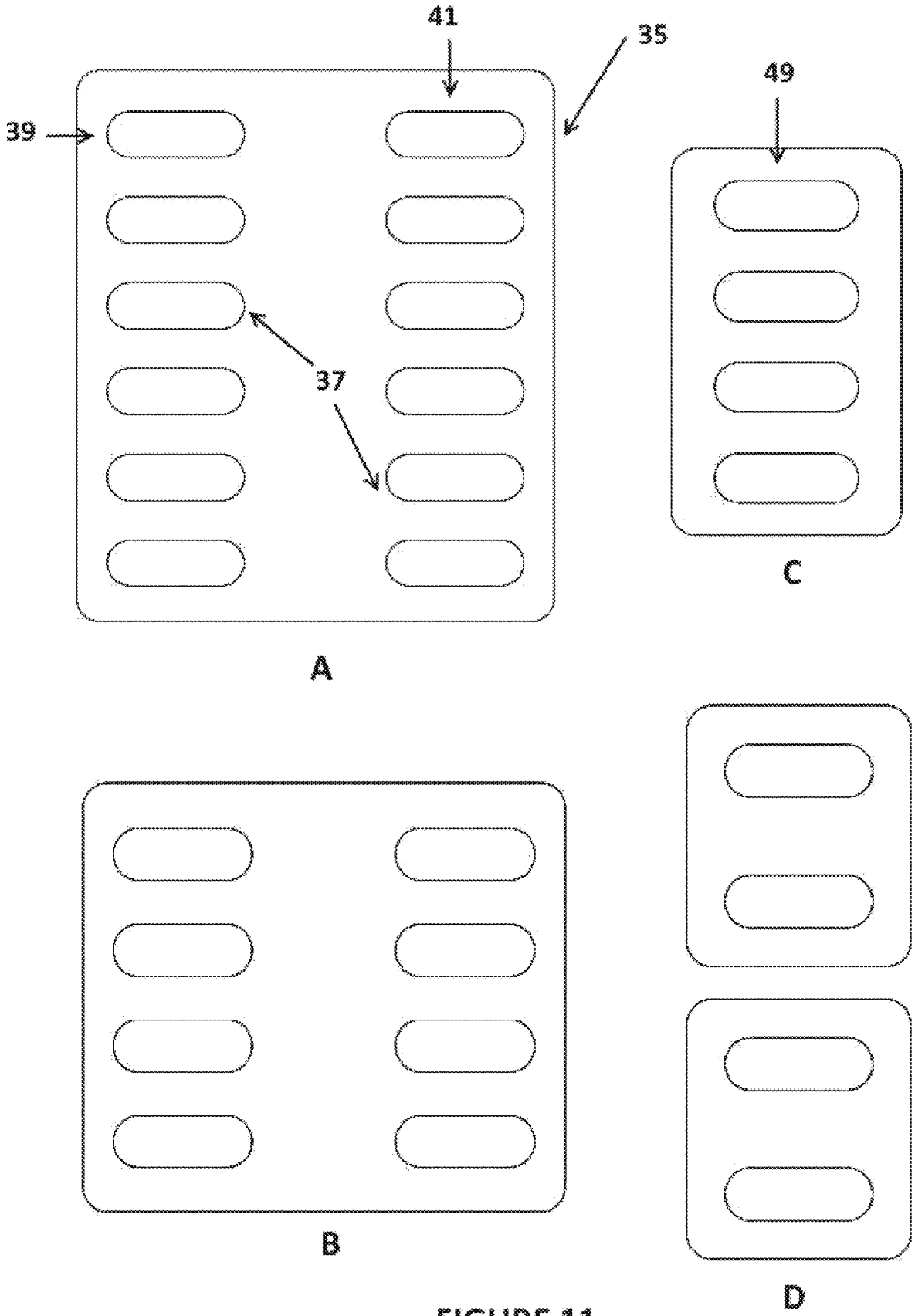
FIG. 11 illustrates different fixing pads used for connecting different elements of the kit in accordance with a preferred embodiment of the invention.

As illustrated on FIG. 11, the fixing pads can have different sizes in accordance with the object that need to be fixed. The fixing pad (A) is large enough the fix the harness the main pouch of the packsack, whereas the fixing pad (B) smaller in size can be sued for fixing a smaller pouch (51), as the one illustrated on FIG. 9, on the bigger pouch presenting a fixing pad on the front as illustrated on FIG. 10. Smaller fixing pads (C, D) can be sewed for affixing other elements to the packsack as described herein below in connection with the kit.

The Kit:

Indeed, and as aforesaid, the present invention is also directed to a kit for assembling a packsack.

Figure 8:
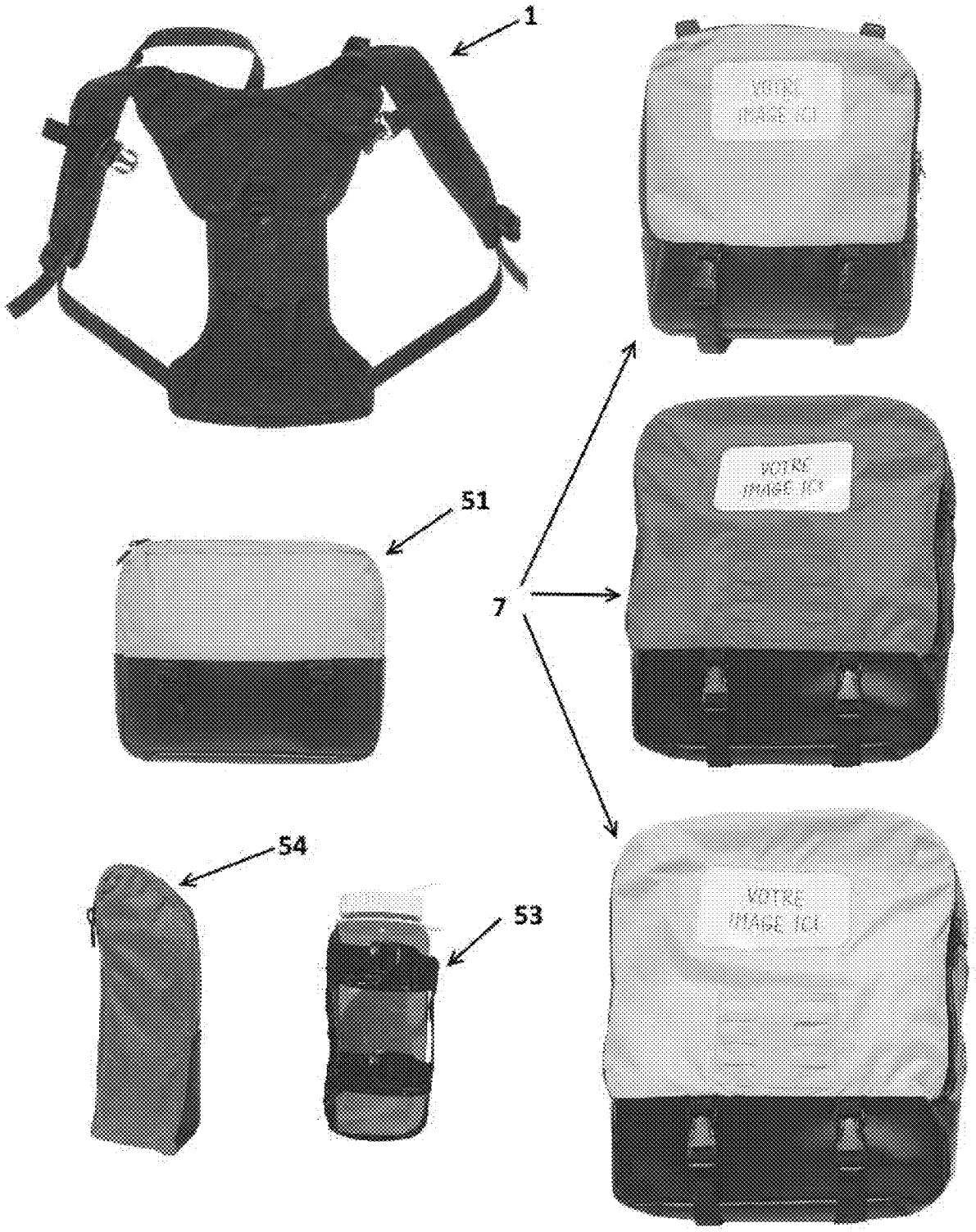
FIG. 8 illustrates different elements of a kit in accordance with a preferred embodiment of the invention.
Figure 9:
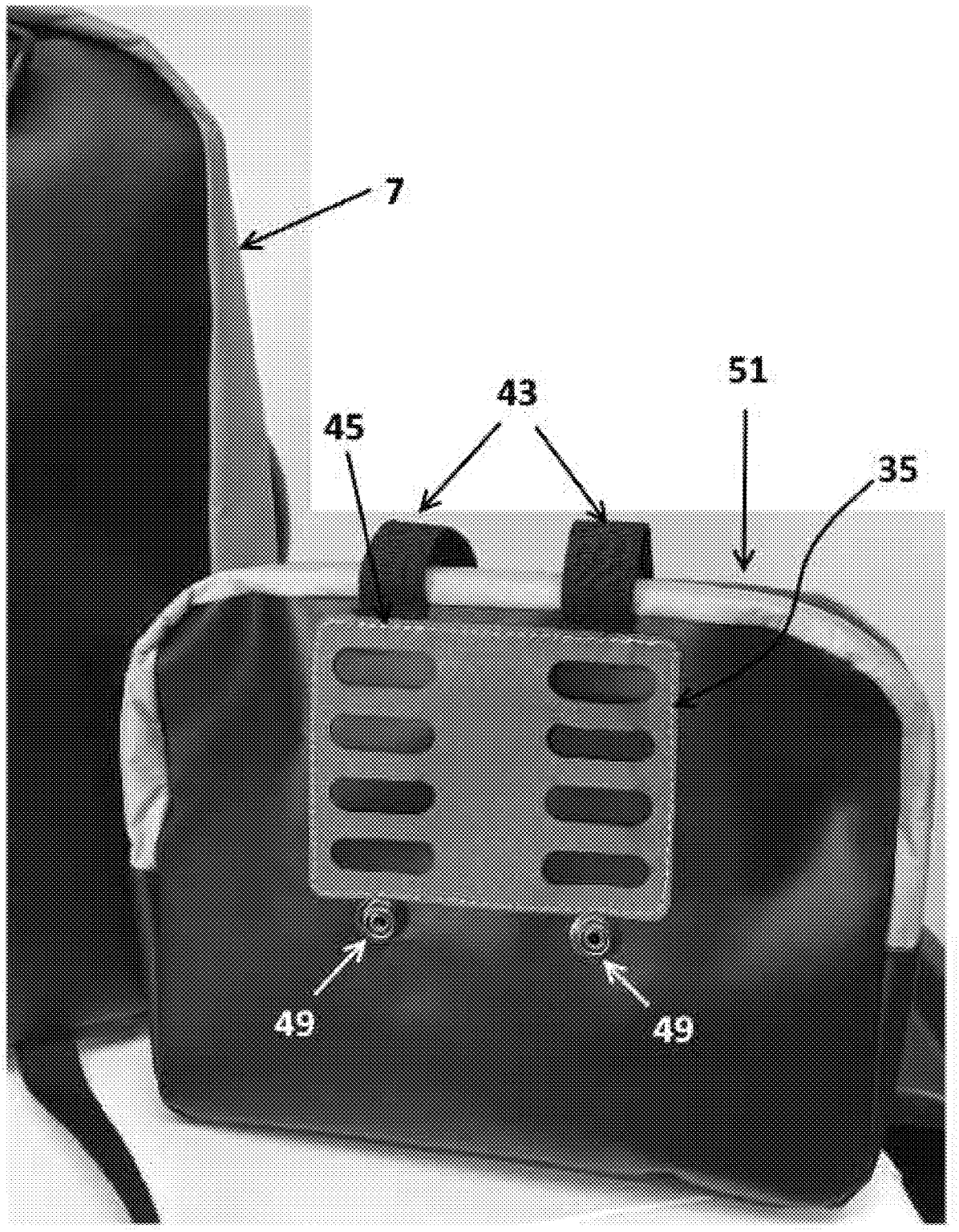
FIG. 9 illustrates an additional smaller pouch of a kit in accordance with a preferred embodiment of the invention.
Figure 10:
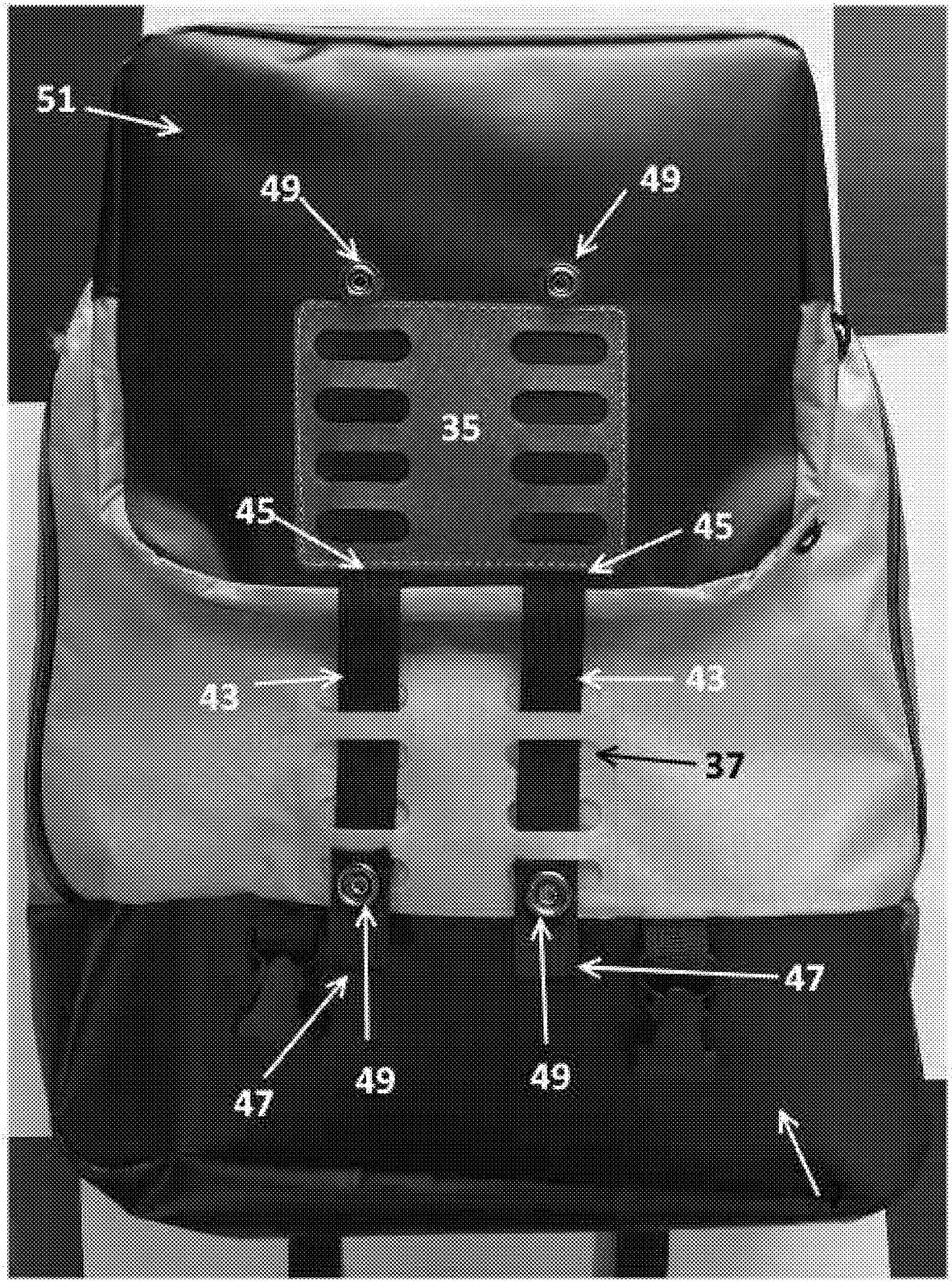
FIG. 10 illustrates how a fixing pad is used for connecting different elements of the kit in accordance with a preferred embodiment of the invention.

As illustrated on FIG. 8, the kit may comprise as main elements: the harness (1) as defined herein; and at least one main pouch (7) to be attached to the harness. Three main pouches are illustrated on FIG. 8 having three different sizes.

The kit may also comprises smaller pouches (51) that can be affixed on the front side of the main pouch (7), a water-bottle dispenser (53) and/or a side pocket (54) that can be affixed on the sides of the main pouch.

The kit may be commercialized with a manual of instructions for assembling the different elements of the kit and using the backpack.

All elements of the kit may comprise a fixing pad such as the MOLLE type fixing pad disclosed herein.

Figure 12:
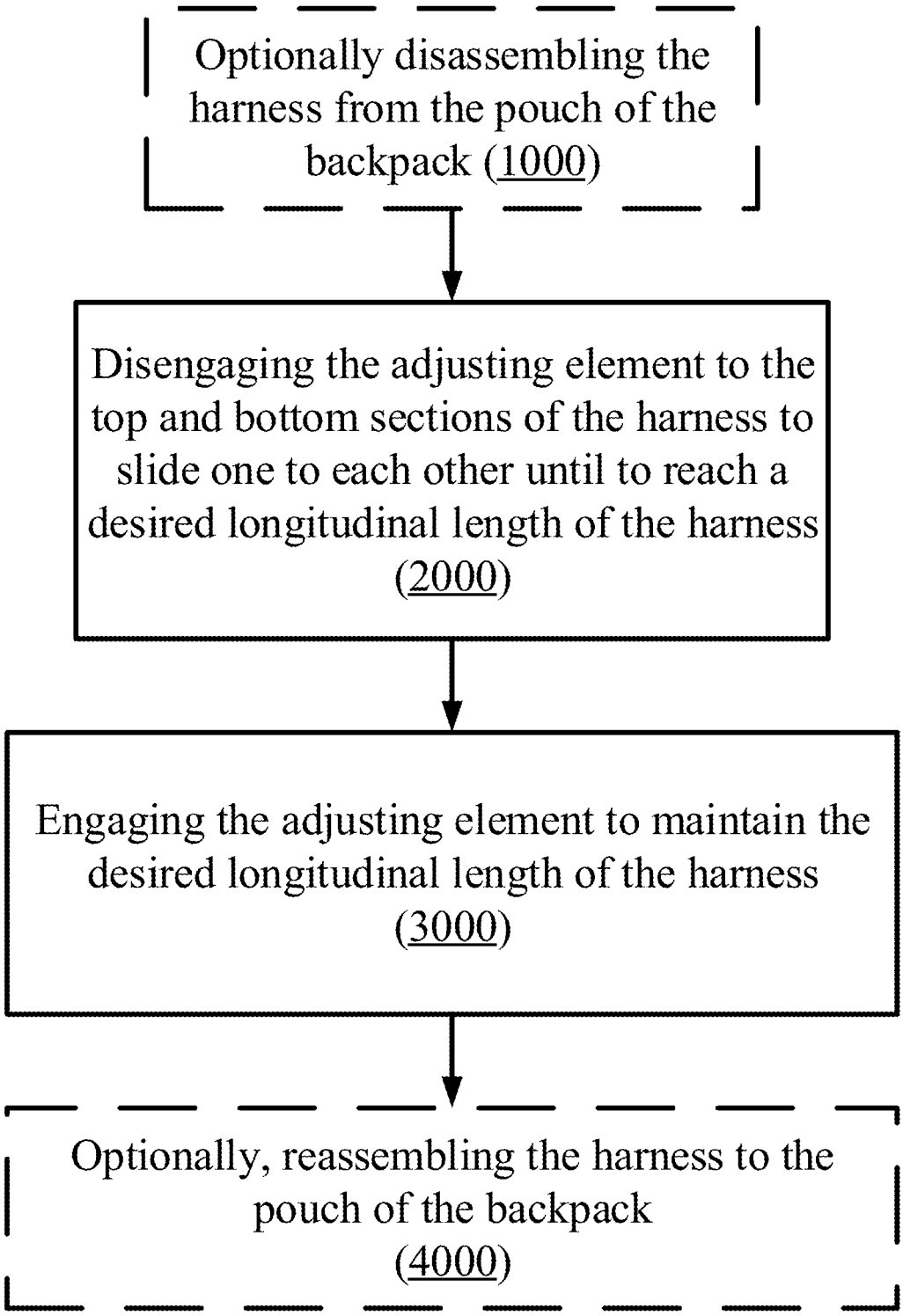
FIG. 12 is a flowchart illustrating a method for adjusting a harness of a backpack in accordance with an embodiment.

The Methods:

As illustrated in FIG. 12, the invention is also directed to a method for adjusting a harness of a backpack, the harness being as defined herein and being optionally removably attached to a pouch. The method comprising the steps of:

a) optionally disassembling the harness from the pouch of the backpack (1000);

b) disengaging the adjusting element to the top and bottom sections of the harness to slide one to each other until to reach a desired longitudinal length of the harness (2000);

c) engaging the adjusting element to maintain the desired longitudinal length of the harness (3000); and d) optionally reassembling the harness to the pouch of the backpack (4000).

The other elements of the kit can be affixed to the packsack using the same method.

The harness according to the present invention is easily adjustable and particularly adapted for kids and school packsacks. When the kid is growing up, the kid can easily adjust the longitudinal length without having to remove or disassemble the harness from the pouch. The harness can be disassembled from the pouch in case, for instance, the pouch is replaced by another pouch of different size.

Although the present invention is particularly adapted for kids, the adjustable harness can be also used for adult packsack for adjusting the longitudinal length of harness to the length of the back or torso of the person using the harness.

Also, a same harness can be used by different persons having different body size for comfort sake.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

The invention claimed is:

1. A harness for a backpack having an adjustable longitudinal length, the harness comprising:

a top section and a bottom section slidably engaging one to each other, wherein the top section defines a pocket having an aperture, wherein the pocket is formed by two layers of fabric having their edges connected together, except on one side forming the aperture, and wherein the bottom section is made of one layer of the same fabric than the top section and is configured to slide within the pocket through the aperture for adjusting the longitudinal length of the harness;

at least one holding system extending from the top section to the bottom section of the harness for holding the harness on a user's back; and an adjusting element connecting the top and bottom sections and configured for maintaining the longitudinal length of the harness once the longitudinal length is adjusted to a given length adapted to the user's back.

2. The harness of claim 1, further comprising a securing system located on one side of the top or bottom section and configured to removably secure a pouch of the backpack to the harness.

3. The harness of claim 1, further comprising a securing strap permanently connecting the bottom section to the top section inside the pocket, the securing strap being entirely hidden inside the pocket when the bottom section is inserted into the pocket of the top section.

4. The harness of claim 1, wherein the adjusting element comprises an adjusting strap having one end secured to the bottom section and a buckle secured to the top section and configured for receiving the adjusting strap.

5. The harness of claim 4, wherein the bottom section has an outside surface for facing the user's back, the outside surface defining an extensible net forming a compartment for hiding an excess of the securing strap once the securing strap is connected to the buckle.

6. The harness of claim 5, wherein the buckle is a ladderlock buckle.

7. The harness of claim 1, wherein the top and bottom sections further comprise at least one cushioning pad extending from a surface intended to face the user's back.

8. The harness of claim 1, wherein the top and bottom sections comprise an air knit fabric facing the user's back.

9. The harness of claim 1, wherein the bottom section comprises a fixing pad attached thereto for facing a pouch of the backpack; the fixing pad comprising a plurality of holes arranged in rows and columns, the pouch comprising at least one fixing strap having one end secured to the pouch and another end configured to be intermingled in the holes of the fixing pad for fixing the pouch to the harness.

10. The harness of claim 9, wherein the other end fixing strap is configured to be snapped to the pouch once the fixing strap is intermingled in the fixing pad of the harness.

11. The harness of claim 1, further comprising a rigid flat component embedded inside the bottom section along the longitudinal axis thereof for rigidifying the bottom section.

12. The harness of claim 1, wherein the at least one holding system comprises a pair of straps extending from the top section to the bottom section and configured to hold the harness on the user's back and to be adjustable in length.

13. The harness of claim 1 for use for assembling a backpack having a pouch, the harness being adjustable to fit the size of a user of the backpack.

14. The harness of claim 13, wherein the user is a kid, the harness being adjustable when the kid is ageing and growing in size.

15. A method for adjusting a harness of a backpack, the harness being as defined in claim 1 and being optionally removably attached to a pouch, the method comprising the steps of:

a) optionally disassembling the harness from the pouch of the backpack;

b) disengaging the adjusting element to the top and bottom sections of the harness to slide one to each other until to reach a desired longitudinal length of the harness;

c) engaging the adjusting element to maintain the desired longitudinal length of the harness; and d) optionally reassembling the harness to the pouch of the backpack.

16. A harness for a backpack having an adjustable longitudinal length, the harness comprising:

a top section and a bottom section slidably engaging one to each other;

at least one holding system extending from the top section to the bottom section of the harness for holding the harness on a user's back; and an adjusting element connecting the top and bottom sections and configured for maintaining the longitudinal length of the harness once the longitudinal length is adjusted to a given length adapted to the user's back;

wherein the adjusting element comprises an adjusting strap having one end secured to the bottom section and a buckle secured to the top section and configured for receiving the adjusting strap, and wherein the bottom section has an outside surface for facing the user's back, the outside surface defining an extensible net forming a compartment for hiding an excess of the securing strap once the securing strap is connected to the buckle.

17. The harness of claim 16, further comprising a securing system located on one side of the top or bottom section and configured to removably secure a pouch of the backpack to the harness.

18. The harness of claim 16, wherein the top section defines a pocket having an aperture, the bottom section being configured to slide within the pocket through the aperture for adjusting the longitudinal length of the harness.

* * * * *